United States Patent [19]

Gates

[11] 4,016,955

[45] Apr. 12, 1977

[54] STEP LADDER WITH PAINT CARRIER APPARATUS

[76] Inventor: Robert B. Gates, R.R. No. 2, Mohall, N. Dak. 58761

[22] Filed: Mar. 25, 1976

[21] Appl. No.: 670,131

[52] U.S. Cl. ..... 182/122; 182/23

[51] Int. Cl.[2] ..... E06C 7/14

[58] Field of Search ..... 182/120, 121, 122, 119, 182/118, 117, 129; 248/238

[56] References Cited

UNITED STATES PATENTS

| | | | |
|---|---|---|---|
| 40,500 | 11/1863 | Philips | 182/23 |
| 88,616 | 4/1869 | Dodge | 182/121 |
| 407,079 | 7/1889 | Laskey | 182/121 |
| 897,929 | 9/1908 | Ridout | 182/120 |
| 1,553,279 | 9/1925 | Wirth | 182/122 |
| 1,984,655 | 12/1934 | Rasmussen | 182/120 |

*Primary Examiner*—Reinaldo P. Machado
*Attorney, Agent, or Firm*—Robert E. Kleve

[57] ABSTRACT

The invention comprising a ladder formed into two sections with one section mounted at its end to the other section and with the other section overlapping so that the sections may be straightened out and used as a straight ladder or folded into a step ladder. Locking means are provided to lock the ladder sections when folded into a step ladder. A paint carrier plate having a center opening so that the paint carrier plate may be slipped over the top of the step ladder and slid downward to rest on the locking means. The paint carrier plate also has a pair of fixed hooks and a pair of pivotally mounted hooks with the hooks being attachable to the rungs of the ladder to attach the paint carrier plate at different heights on the rungs of the ladder.

1 Claim, 5 Drawing Figures

STEP LADDER WITH PAINT CARRIER APPARATUS

This invention relates to ladders.

It is an object of the invention to provide a novel ladder which can be folded outward as a straight ladder folded toward one another to serve as a step ladder and which has a novel paint carrier plate which can be attached to various positions as the ladder to support cans of paint and other items on the ladder.

It is another object of the invention to provide a novel ladder apparatus which can serve either as a straight ladder or as a step ladder and which has a novel structure for supporting paint, brushes, and tools while using the ladder and which structure can be attached to different positions on the ladder.

Further objects and advantages of the invention will become apparent as the description proceeds and when taken in conjunction with the accompanying drawing wherein.

Briefly stated, the invention comprises a ladder having a center folding connection so that the ladder can be used either as a straight ladder or folded to be used as a step ladder, a paint carrier plate having a center hole with outward projecting carrier plates, so that the top of the step ladder can be received in the center hole of the paint carrier apparatus and the paint carrier apparatus can be slipped down a short distance and maintained in that position on the step ladder and which paint carrier plate also has pivotally mounted hooks and forwardly projecting hooks which can be hooked over any two selected rungs to the ladder to support the paint carrier plate at a selected height on the ladder.

Figure 1:
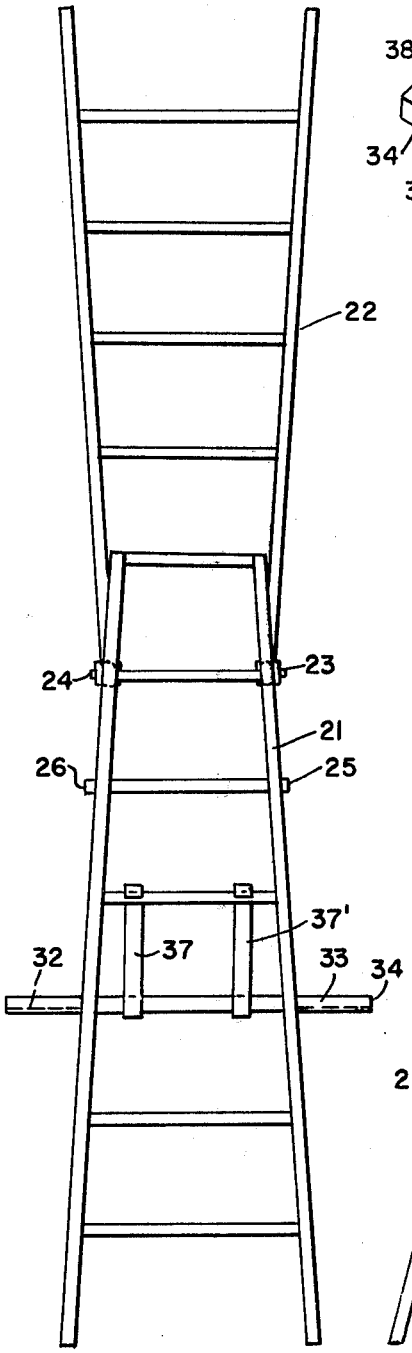
FIG. 1 is a front elevational view of the ladder folded out as a straight ladder with a paint carrier plate attached to the ladder in a selected position.
Figure 3:
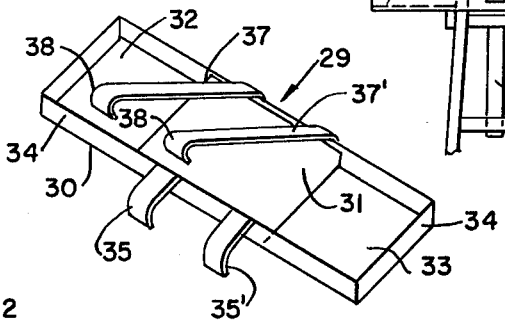
FIG. 3 is a perspective view of the paint carrier apparatus.

Referring more particularly to the drawings in FIG. 1, the step ladder invention 19 is illustrated having a ladder section 21 and a ladder section 22, which are pivotally connected together by a dual pair of hinges 23 and 24 fixed to ladder section 22 and pins 23′ and 24′ running through hinges 23 and 24, respectively, and through ladder section 22.

The ladder sections 21 and 22, when straightened out as illustrated in FIG. 1, overlap at their central portion to brace the two sections in a straight line when using the ladder sections as a straight ladder.

Figure 2:
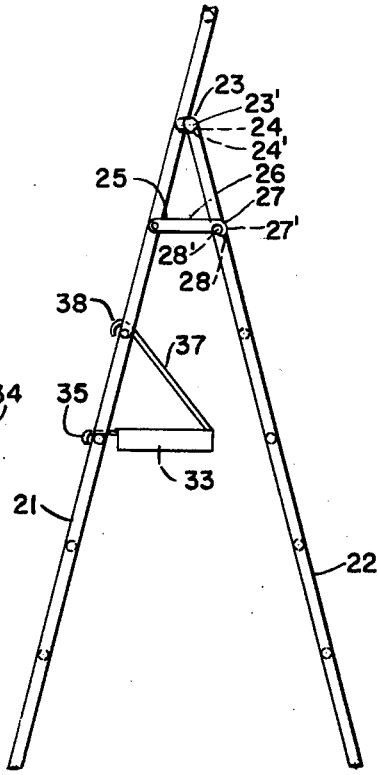
FIG. 2 is a side elevational view of the ladder folded back as a step ladder with the paint carrier apparatus attached to the ladder in a selected position.

The two ladder sections 21 and 22 can be pivoted toward one another as illustrated in FIG. 2, a pair of plates 25 and 26 are pivotally mounted on their one end to ladder section 21 and have hook ends 27 and 27′ which hook over pins 28 and 28′ fixed in section 22 to lock the two ladder sections together so they can be used as a step ladder.

A paint carrier plate 29 is provided having a rectangular frame 30 with a hollow center 31 and a pair of base plates 32 and 33 fixed to the outer ends of the rectangular frame. Side walls 34 are fixed about the outside edges of the plates 32 and 33. The base plates 32 and 33 provide a support for carrying paint cans thereon and other items. A pair of hooks 35 and 35′ are fixed to the center 36 on the side of the frame and project outwardly. A pair of hooks 37 and 37′ are pivotaly mounted to the other side of the frame and have hook portions 38 and 38′.

The paint carrier plate 29 can be attached to the ladder when used as a straight ladder or as a step ladder, as illustrated in FIGS. 1 and 2, on any selected two adjacent rungs on the ladder by attaching the fixed hooks 35 and 35′ over the lower of the two rungs and hooking the hooks 38 and 38′ of the pivotally mounted hooks 37 and 37′ over the next rung thereabove, as illustrated.

Figure 4:
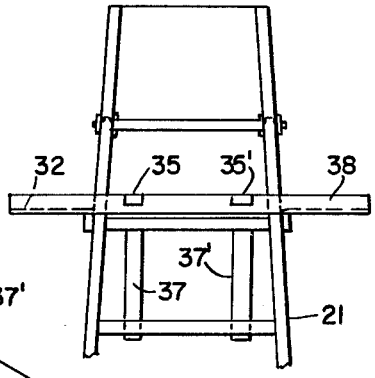
FIG. 4 is a fragmentary front elevational view of the ladder when used as a step ladder with the paint carrier apparatus attached in an upper position slipped over the top of the step ladder.
Figure 5:
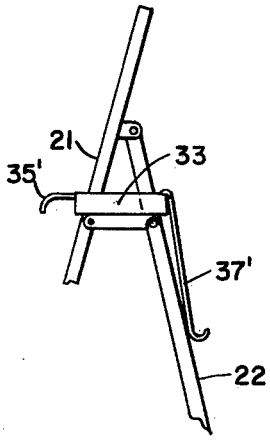
FIG. 5 is a fragmentary side elevational view of the ladder when used as a step ladder with the paint carrier apparatus attached in an upper position slipped over the top of the step ladder.

Also, the paint carrier plate 29 can be slipped over the outside of the top of the step ladder, as illustrated in FIGS. 4 and 5, by sliding the carrier plate 29 down over the top of the step ladder with the top of the step ladder being received in the hollow center 31 of the plate 29 and sliding the carrier plate down until the base plates 32 and 33 rest upon the plates 25 and 26 to thereby support the carrier plate 29 on the step ladder. Also, the sides 39 and 39′ of the carrier plate will become into close adjacent contact with the outside of the ladder when the carrier plate is resting upon the plates 32 and 33 so that the carrier plate will not slide from left to right or right to left when viewed from FIG. 5.

Thus it will be seen that a novel ladder apparatus has been provided which has a novel paint carrier plate which can be moved and attached to various different positions on the ladder when used as a straight ladder or as a step ladder.

It will be obvious that various changes and departures may be made to the invention without departing from the spirit and scope thereof and accordingly, it is not intended that the invention be limited to that specifically described in the specification or as illustrated in the drawing but only as set forth in the appended claims wherein.

What is claimed is:

1. A ladder and paint carrier plate, said ladder comprising two ladder sections with one section pivotally mounted at its end to the other section and with the other section overlapping the first section so that the sections may be straightened out and used as a step ladder or folded into a step ladder, said ladder having locking means to lock the ladder sections when folded into a step ladder, said paint carrier plate having a center opening so that the paint carrier plate may be slipped over the top of the step ladder and slid downward to rest on the locking means, said paint carrier plate also comprising a pair of hooks pivotally mounted to the paint carrier plate and a pair of hooks fixed to the paint carrier plate, with the hooks being attachable to the rungs of the ladder to attach the paint carrier plate at different heights on the rungs of the ladder.

* * * * *